United States Patent [19]

Hartzheim

[11] Patent Number: 4,756,641

[45] Date of Patent: Jul. 12, 1988

[54] SAND PLATE AND CONCRETE REINFORCEMENT SUPPORT

[76] Inventor: George Hartzheim, P.O. Box 3396, Orange, Calif. 92665

[21] Appl. No.: 92,071

[22] Filed: Sep. 2, 1987

[51] Int. Cl.[4] ..... E01C 11/18

[52] U.S. Cl. ..... 404/136; 52/689

[58] Field of Search ..... 404/70, 71, 100, 134–136; 248/65, 80, 83; 52/677, 687, 689

[56] References Cited

U.S. PATENT DOCUMENTS

| | | | |
|---|---|---|---|
| 1,289,688 | 12/1918 | Davis | 404/136 X |
| 1,672,852 | 6/1928 | Roughan | 404/136 X |
| 1,809,870 | 6/1931 | Smith | 404/135 X |
| 1,936,536 | 11/1933 | Bates | 404/134 X |
| 3,693,310 | 9/1972 | Middleton | 52/689 X |
| 4,060,954 | 12/1977 | Liuzza | 52/689 X |
| 4,080,770 | 3/1978 | Vigh | 52/689 |
| 4,655,023 | 4/1987 | Yung | 52/689 X |
| 4,682,461 | 7/1987 | Sizemore | 52/689 |

FOREIGN PATENT DOCUMENTS

| | | | |
|---|---|---|---|
| 2549870 | 2/1985 | France | 404/135 |

*Primary Examiner*—George A. Suchfield

*Assistant Examiner*—John F. Letchford

*Attorney, Agent, or Firm*—Charles H. Thomas

[57] ABSTRACT

An improved system is provided for elevating and supporting reinforcement rods above an earthen bed upon which concrete is poured. A flat, disk-shaped sand plate is disposed in contact with the earthen bed and has a plurality of channels adapted to receive pedestal feet extending upwardly from its top surface and radially from its center toward the periphery thereof. The height of the channel walls is greater above the periphery of the base than above the center of the base and the interior surfaces of the channel walls converge from the periphery toward the center and from the tops of the walls toward the top surface of the sand plate. A pedestal is disposed atop the sand plate with feet wedged into the pedestal foot channels. The configuration of the pedestal foot channels allows the sand plate to accommodate pedestals of a wide variety of sizes. The lowermost portions of the outer edges of the pedestal legs are vertically oriented parallel to each other and perpendicular to the sand plate to provide greater stability. The pedestal legs may be joined together by laterally oriented stabilizing rings or provided with reinforcing gussets.

15 Claims, 1 Drawing Sheet

SAND PLATE AND CONCRETE REINFORCEMENT SUPPORT

BACKGROUND OF THE INVENTION

1. Field of the Invention

The present invention relates to improved devices for supporting reinforcement rods within concrete so that the rods are held at selected levels above an earthen bed upon which the concrete is poured while the concrete sets up and hardens.

2. Description of the Prior Art

In pouring concrete to form roads, building slabs, sidewalks, bicycle paths and other slab-like structures on earthern beds, laterally extending reinforcement within the concrete is often required. Such reinforcement typically takes the form of a matrix of steel reinforcement "rebar" rods which are often tied together by wires to form a horizontally disposed, rectilinear grid. To properly reinforce a concrete slab it is extremely important for the reinforcement rods to be positioned at an appropriate elevation above the bed upon which the concrete is to be poured so that reinforcement is provided well within the structure of the concrete slab, and not merely on the lower face of the slab which resides in contact with the bed upon which the concrete is poured.

Supporting pedestals are provided to hold the reinforcement rods above the bed upon which the concrete is poured. The supporting pedestals are positioned at intervals which are spaced closely enough so that the reinforcement rods will not sag excessively between the supporting pedestals. Since the reinforcement rods are frequently quite heavy, it is often necessary to space the supporting pedestals every few inches in order to adequately support the reinforcement rods at the desired level above grade.

One very suitable type of pedestal for use in supporting reinforcement rods in concrete is constructed of molded high density plastic and is configured with a concave seat or cradle at its upper extremity, formed with a concave surface configured to receive and support conventional generally cylindrical steel reinforcing rods. The pedestal is provided with a plurality of uniformly spaced legs which diverge radially outwardly and downwardly at an inclination relative to the reinforcing rod seat. The pedestal legs terminate in feet which are spaced at uniform intervals radially outwardly from the center of the seat so as to provide the pedestal with some stability.

Reinforcing rod supporting pedestals of the type described are utilized both for supporting reinforcement rods above a solid, flat surface upon which concrete is to be poured, such as a wooden deck, and also to support reinforcement rods above a less stable foundation, such as an earthen bed of sand, gravel or soil. When reinforcement rod pedestals are placed upon a soft earthen bed, such as sand, the weight of the reinforcement rods causes the pedestal feet to dig into the sand or gravel. As a result, the pedestal is likely to tip and will not properly support the reinforcing rods at the desired elevation if placed directly upon an earthen bed.

To prevent the reinforcing rod pedestal from tipping, a flat bearing plate, known in the trade as a sand plate, is utilized to distribute weight from a pedestal located thereon. A conventional sand plate is a generally flat, disk-shaped structure which more uniformly distributes weight bearing downwardly through the pedestal legs and through the pedestal feet across a much greater surface area than the contact area of the pedestal feet. To ensure that the feet of the pedestal do not slip upon the sand plate, the sand plate is equipped with locating guides which are particularly adapted for use with a pedestal having feet of a particular size and located at specific distances of spatial separation from each other. Conventional sand plates and pedestals are thereby sold together as sets, and a particular model of sand plate is especially adapted for use with only a particular model of pedestal. Thus, in arranging for reinforcing rod supports a contractor or project engineer is forced to accurately coordinate the purchase of the proper quantity of sand plates for use with each different model of reinforcing rod pedestal purchased.

SUMMARY OF THE INVENTION

One object of the present invention is to provide a universal sand plate which has a unique configuration that lends itself for use with a wide variety of different models of reinforcing rod pedestals of varying sizes and configurations. Reinforcing rod supporting pedestals range in height from three-quarter inches to five inches and are provided in incremental sizes within this range varying by one-quarter or one-half an inch. A contractor or project engineer may therefore select from approximately a dozen different sizes of pedestals. Utilizing the improved sand plate of the invention two different models of sand plates will fit all of the commercially available pedestal sizes. Thus, a contractor or project engineer may stock the two different models of sand plates without regard to the particular number of reinforcing rod pedestals required for a particular job, as one of the two models of sand plates will receive and support any of the different sizes of reinforcing rod pedestals which are commercially available.

In one broad aspect the invention may be considered to be an improved sand plate for supporting concrete reinforcing rod pedestals comprising: a flat base having top and bottom surfaces, a center and a periphery, and a plurality of pedestal foot channels having walls extending upwardly to their tops from the top surface of the base and extending radially from the center of the base toward the periphery thereof, wherein the height of the channel walls is greater above the periphery of the base than above the center of the base and the interior surfaces of the channel walls converge from the periphery toward the center and from their tops toward the top surface of the base. That is, the interior surfaces of the channel walls are tapered in three different directions, downwardly, radially inwardly, and in height from the periphery toward the center. As a consequence, the improved sand plate is able to accommodate a wide variety of sizes of reinforcing rod supporting pedestals.

Conventional reinforcing rod supporting pedestals are typically formed with four legs, terminating in feet, spaced ninety degrees apart as viewed from above. As the height of the different sizes of pedestals is incrementally increased, so is the distance in spacing between the pedestal feet, and the lateral thickness of the pedestal feet. Thus, the feet of a large reinforcing rod pedestal will be spaced a considerable distance apart, and the material forming the feet will be relatively thick. Conversely, a pedestal of a small height will have closely spaced feet formed of relatively thin material.

The walls of the channels of the sand plate of the invention converge downwardly from their top edges so that the channel is of an inverted trapezoidal, trough-shaped configuration. Similarly, the lower extremities of the legs of conventional reinforcing rod pedestals likewise are tapered slightly so that they narrow at the pedestal feet. As a consequence, the pedestal feet are essentially wedged into the sand plate channels when the pedestal is mounted on the sand plate.

Preferably, both the reinforcing rod pedestal and the sand plate are each formed separately as a unitary, molded plastic structure. When the channel walls are formed of plastic, they are elastically resilient and thus releasably receive the pedestal feet in removable engagement in the foot channels. As the pedestal feet are forced into the foot channels, the plastic channel walls are slightly elastically deformed to allow the pedestal feet to contact the channel floor. With the pedestal feet wedged into the channels in this manner, a firm frictional engagement between the pedestal and the sand plate exists. The pedestals are then unlikely to be dislodged from the sand plate by flowing, uncured concrete aggregate being poured into place on the earthen bed upon which the sand plates rest.

Another unique aspect of the invention resides in the structure of the pedestals. For many years reinforcing rod pedestals were formed of steel which provided reinforcing rod supports strong enough to withstand forces imposed by weight from above and by uncured concrete aggregate being poured onto the pedestals. However, once the steel pedestals are entrapped in poured concrete, they are likely to contribute to degradation of the concrete slab in several ways. The iron of steel pedestals does rust. Water flowing onto the concrete contains oxygen which will rust the steel pedestals and cause rust stains and "bleeding" marks on the concrete. Such stains and marks render the concrete structure unsightly. Moreover, as the steel pedestals rust and disintegrate over the years, the deteriorating iron oxide is washed from the concrete structure, thus leaving cavities within which moisture can collect. The collecting moisture accelerates the rusting and disintegration of the remaining portions of the pedestals. Furthermore, when subjected to freezing temperatures the moisture will expand and crack the concrete.

By providing reinforcing rod pedestals constructed as unitary, molded structures, the adverse effects which are present with deteriorating steel pedestals are avoided. The plastic pedestals of the invention are preferably formed of high density, polyvinyl chloride, polycarbonate or ABS. These materials are essentially impervious to moisture and oxygen, and do not deteriorate with time as do metal reinforcing rod pedestals. However, a unique configuration of the pedestals is required in order to provide the necessary strength to withstand the forces to which the pedestals are subjected.

On one preferred embodimment of the invention the pedestal legs are all joined together above the pedestal feet by a laterally oriented, stablizing ring. The ring is formed as part of the unitary, molded plastic structure, so that weakness at the demarcation between the structure of the pedestal legs and the structure of the stabilizing ring is avoided. Indeed, plastic pedestals constructed in this manner are from two to three times stronger than metal pedestals of the same size, and do not have the disadvantages of metal pedestals, as previously described.

In the small sizes of pedestals a lateral, stabilizing ring cannot be used because it would tend to block the flowing concrete aggregate and inhibit the flow of aggregate into the region beneath the center of the pedestal between the pedestal legs. If the flow of aggregate is blocked in this fashion, a cavity, which forms a weakness in the concrete can be formed. Consequently, the smaller sizes of pedestals are provided with reinforcing gussets at intermediate locations on the pedestal legs. In both the pedestals with lateral stabilizing rings and in the pedestals with reinforcing gussets the portions of the outer edges of the pedestal legs beneath the reinforcing ring or gussets are vertically oriented. Thus, while the pedestal legs diverge from the reinforcing rod seat down to the pedestal reinforcing ring or gussets, the outer edges of the pedestal legs extend vertically from the reinforcing ring or gussets to the pedestal feet. Such a construction provides a significant stability to the lower extremities of the pedestal legs, in contrast with pedestal legs which are inclined throughout their entire lengths.

A further preferred feature of pedestal construction according to the invention is a construction of the pedestal legs in which the inner and outer edges of at least the upper portions of the legs are mutually parallel to each other and are inclined between the pedestal seat and the reinforcing ring or gussets. This allows a plurality of pedestals to be stacked in nested, partially overlapping fashion, one atop another. Such a nesting arrangement allows a greater number of the pedestals to be stored and packed within a given volume, and thereby reduces shipping, and inventory costs.

In another broad aspect the invention may be considered to be an improvement in a device for supporting a reinforcing rod within concrete that is poured on an earthen bed and which includes a flat base having top and bottom surfaces and a pedestal having feet which rest on the top surface of the base and a concave cradle forming a rest for a longitudinal reinforcing rod. According to the improvement of the invention the flat base has a center and a periphery and a plurality of pedestal foot channels formed by pairs of walls rising upwardly from the top surface wherein the walls have top edges which are of a height greater at the periphery than at the center and interior facing surfaces in each pair of walls which converge from the periphery toward the center and from the top edges toward the top surface of the base.

The invention may be described with greater clarity and particularity by reference to the accompanying drawings.

DESCRIPTION OF THE EMBODIMENTS

Figure 1:
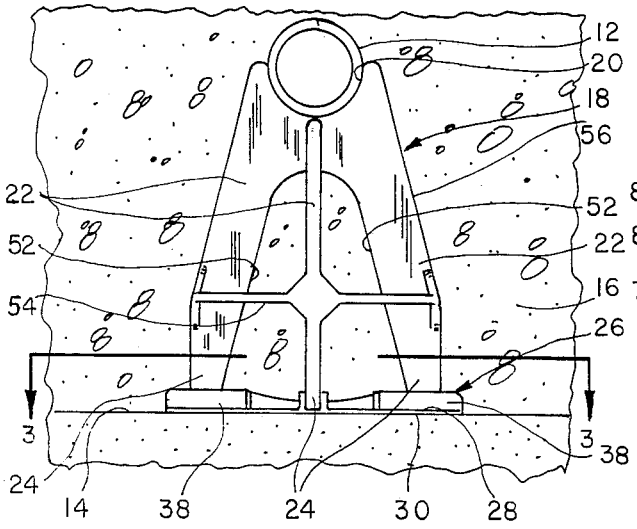
FIG. 1 is a side elevational view of one preferred embodiment of the invention shown embedded in concrete, with the concrete depicted in cross section.
Figure 2:
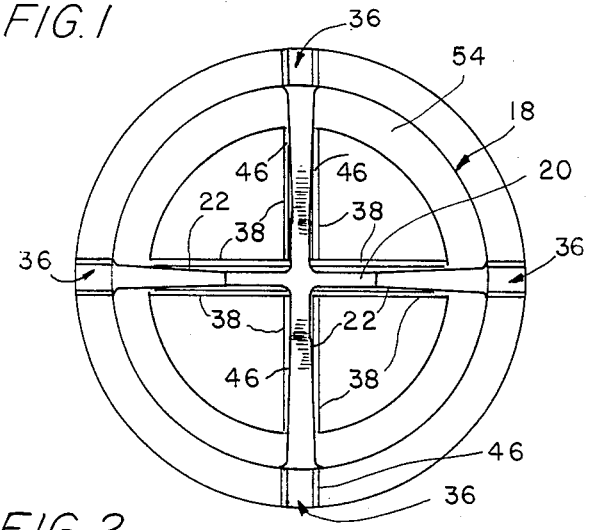
FIG. 2 is a top plan view of the embodiment of FIG. 1, shown in isolation.
Figure 3:
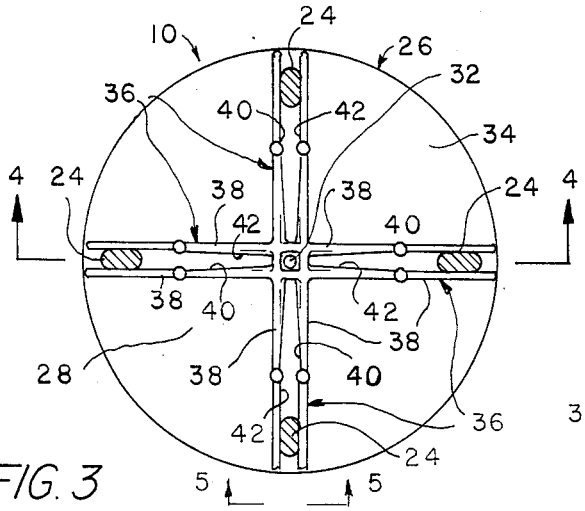
FIG. 3 is a sectional plan view taken along the lines 3—3 of 1.
Figure 4:
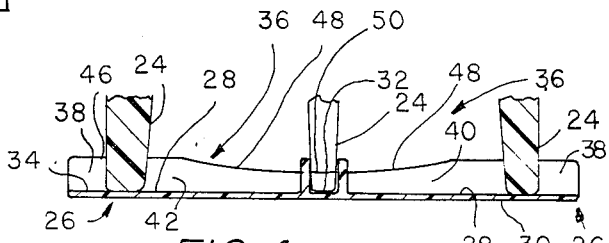
FIG. 4 is a sectional elevational detail taken along the line 4—4 of FIG. 3.

FIGS. 1 and 2 illustrate a device 10 for supporting reinforcing rods, such as the reinforcing rod 12 above an earthen bed 14 upon which concrete 16 is poured. The device 10 includes a pedestal 18 having a seat 20 for cradling a reinforcing rod 12 and legs 22 with feet 24 for holding the seat 20 at a desired elevation above the earthen bed 14. The device 10 also includes a flat bearing plate 26, known in the trade as a sand plate, for distributing weight from the pedestal 18 located thereon. The sand plate 26 has a top surface 28, a bottom surface 30, a center 32 and a periphery 34, as depicted in FIGS. 1 and 3. The improved sand plate 26 is comprised of a plurality of channels 36, best depicted in FIG. 3. The channels 36 are formed on the top surface 28 by upright walls 38 that rise in pairs from the top surface 28 outwardly from the center 32 toward the periphery 34. The pairs of channel walls 38 are spaced apart ninety degrees, as illustrated in FIG. 3. As illustrated in FIG. 4, the heights of the walls 38 are greater at the periphery 34 than at the center 32. The pairs of walls 38 have mutually facing interior surfaces 40 and 42 which converge from their greatest heights at the periphery 34 toward the top surface 28 of the sand plate 26, as viewed in FIG. 4, and from the periphery 34 toward the center 32 of the sand plate 26, as viewed in FIG. 3.

Figure 5:
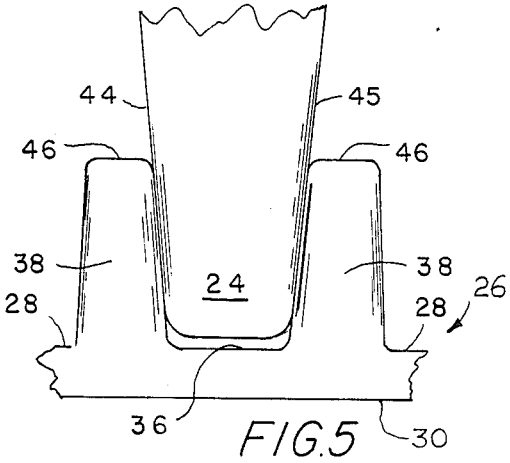
FIG. 5 is an elevational detail taken along the lines 5—5 of FIG. 3.

The sand plate 26 is formed as a unitary molded structure of high density plastic. The channel walls 38 yield resiliently to receive the feet 24 of a pedestal 18 which are inserted into the foot channels 38 in wedged engagement therewith, as illustrated in FIG. 5. That is, when the pedestal foot 24 is pressed downwardly into the channel 36 in the manner illustrated in FIG. 5, the wedging action of the insertion of the tapered foot 24 presses laterally outwardly in both directions against the interior surfaces 40 and 42 of the channel walls 38, thereby resiliently deflecting the channel walls at the location at which the pedestal foot 24 is inserted. Because the deformation of the channel walls is elastic, the channel walls 38 tend to return to their original configuration, and thereby exert a significant pressure inwardly against the sides 44 and 45 of the pedestal feet 24. This force tends to hold the pedestal foot 24 firmly seated in the channel 36 so that the pedestal 18 is not dislodged from the sand plate 26 as a result of forces exerted thereon by uncured concrete aggregate being poured onto the device 10.

As illustrated in FIG. 4, the top edges 46 of the channel walls 38 are highest at the periphery 34 of the top surface 28 of the sand plate 26 and are lowest at the center 32 thereof. The channel walls 38 extend radially inwardly at a uniform height above the top surface 28 at the outer periphery of the top surface 28, but slope downwardly at an intermediate region indicated at 48, and are lowest in the region indicated at 50 directly above the center 32 of the sand plate 26. The reduction in height of the channel walls 38 toward the center 32 reduces the barrier to the flowing concrete aggregate, so that as the concrete is poured, it is able to flow into the space beneath and between the pedestal legs 22, without leaving cavities between the pedestal legs 22. Such cavities would form points of weakness and provide locations for the collection of moisture. However, even a small reduction in height of the channel walls 38 of only three-sixteenths of an inch from the periphery 34 to the center 32 provides a significant improvement in the extent to which concrete flows in between the pedestal legs 22. This effect is particular pronounced in the case of the smaller sizes of pedestals, where there is less clearance between the top surface 28 of the sand plate 26 and the interior edges 52 of the pedestal legs 22.

As best illustrated in FIG. 3, the separation between the interior surfaces 40 and 42 of the channel walls 38 is greater at the periphery 34 of the sand plate 26 than at the center 32 thereof. The particular embodiment of the pedestal 18 depicted in FIGS. 1 and 3 is one of the larger sizes of pedestals employed. Consequently, the feet 24 thereof are separated by a considerable distance and are relatively thick. That is, the thickness of the pedestal feet between the surfaces 44 and 45 is relatively large. The sand plate wall configuration thereby conforms appropriately to the thickness of the pedestal feet 24 and the spacing between the pedestal feet 24. The feet 24 of the larger size pedestal 18 are wedged between the channel walls 38 in each pair of channel walls near the periphery 34 of the sand plate 26 where the interior channel wall surfaces 40 and 42 have their greatest separation.

In contrast, the feet of a pedestal of a smaller height are spaced more closely together and are thinner. When inserted into the channels 38 of the sand plate 26 the feet of the smaller size pedestals will be wedged between each pair of channel walls 38 closer to the center 32 where the separation between the interior surfaces 40 and 42 is less. As a result, the sand plate 26 is able to effectively grip the pedestal feet of pedestals having a wide variety of sizes.

As illustrated in FIG. 5, the channel walls 38 are of generally trapezoidal cross section so that the channels 36 are formed generally in the trough-shaped cross sectional configuration of an inverted trapezoid. That is, the walls 38 are thicker proximate to the top surface 28 and are thinest at their upper edges 46. The opposing surfaces 44 and 45 of the pedestal feet 24 are likewise tapered downwardly in converging fashion at an angle of convergence closely corresponding to the vertical slope of the interior surfaces 40 and 42 of the channel walls 38. Accordingly, the pedestal feet 24 are firmly wedged into the channels 36, and resist forces exerted from flowing concrete aggregate that tend to dislodge the pedestal 18 from the sand plate 26.

Figure 6:
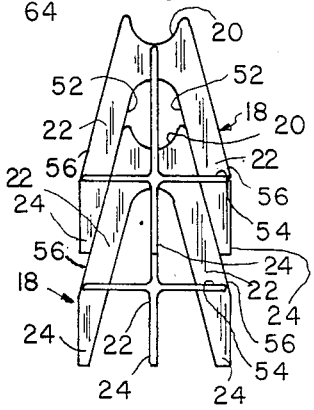
FIG. 6 illustrates a plurality of a preferred embodiment of pedestal of the invention stacked together.

As best illustrated in FIG. 3, the pairs of channel walls 38 are arranged at uniformly spaced intervals extending from the center 32 of the sand plate 26 toward the periphery thereof. Likewise, the pedestal feet 24 are spaced at uniform intervals corresponding to the spacing of the pairs of walls 38. As illustrated in FIGS. 1 and 2, the pedestal legs 22 are all joined together above the feet 24 by an annular, laterally oriented stabilizng ring 54. The stablizing ring 54 adds considerably to the strength of the pedestal 18 and prevents the pedestal 18 form collapsing under the large forces exerted by poured concrete falling on the reinforcing rod supports 10. As illustrated in FIG. 1, all of the pedestal legs 22 diverge outwardly at a uniform inclination from the seat 20 and each of the pedestal legs 22 has inner and outer edges 52 and 56, respectively. At least the upper portions of the edges 52 and 56 above the reinforcing ring 54 are mutually parallel to each other between the pedestal seat 20 and the stabilizing ring 54, whereby a plurality of pedestals 18 are stackable in a nested, partially overlapping fashion, one atop another, as depicted in FIG. 6. The ability to nest the pedestals 18 together as depicted in FIG. 6 greatly reduces the volume required to package and inventory quanitities of the pedestals 18.

The lower portions of the outer edges 56 of the pedestal legs 22 beneath the stabilizing ring 54 are preferably not inclined, however, but to the contrary are vertically oriented. The edges 56 extend vertically downwardly from the outer edge of the ring 54 and terminate at the feet 24 of the pedestal 18. The lower portions of the outer leg edges 56 are thereby perpendicular to the stabilizing ring 54 and to the top surface 28 of the sand plate 26. This configuration of the lower portion of the legs 22 also enhances the stability and strength of the pedestal 18.

To support reinforcing rods prior to pouring concrete, a multiplicity of reinforcing rod supporting devices 10 are first deployed. The supporting devices 10 are assembled by first inserting the feet 24 of the pedestals 18 into the channels 36 of the sand plate 26. A multiplicity of the supporting devices 10 are then deployed at spaced intervals with the bottom surfaces 30 of the sand plates 26 resting upon the earthen bed 14 upon which concrete is to be poured, and with the reinforcing rods 12 held at an elevated distance above the earthen bed 14 in the seats or cradles 20 of the pedestals 18. The supporting devices 10 are spaced closely enough together so that the reinforcing rods 12 do not sag significantly between the supporting devices 10. Once all of the necessary supporting devices 10 have been deployed in a matrix to support the reinforcing rods 12, concrete 16 is poured upon earthen bed 14. The devices 10 will not collapse despite the significant weight and forces that result from heavy concrete being poured thereon. Once the concrete 16 has cured the supporting devices 10 remain entrapped therein. Since the supporting devices 10 are constructed entirely of plastic, they do not deteriorate with time and therefore do not degrade either the appearance or structural integrity of the concrete 16.

Figure 7:
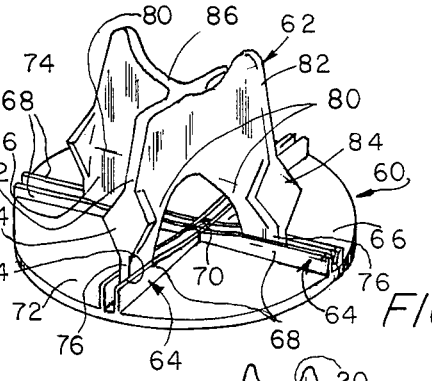
FIG. 7 illustrates an alternative embodiment of a pedestal according to the invention.

The sand plate 26 depicted in FIGS. 1, 2 and 3 is preferably about four and one-quarter inches in diameter. The sand plate 26 accommodates all of the larger sizes of pedestals used to support reinforcing rods 12 at selected elevations above the earthen bed 14. Where the reinforcing rods 12 are to be supported above the earthen bed 14 in close proximity thereto, a smaller diameter sand plate 60 is employed, as depicted in FIG. 7. The sand plate 60 is constructed in the same manner as the sand plate 26, but is merely of a smaller size. The sand plate 60 preferably has a diameter of about three and one-sixteenth inches. The sand plate 60 is utilized to accommodate the smallest sizes of reinforcing rod supporting pedestals such as the pedestal 62 depicted in FIG. 7.

Like the sand plate 26, the sand plate 60 is comprised of a plurality of channels 64 formed on its top surface 66 by upright walls 68 which rise in pairs from the top surface 66 outwardly from the center 70 toward the periphery 72. The channel walls 68 extend to heights which are greater at the periphery 72 than at the center 70. The pairs of walls 68 have mutually facing interior surfaces which converge from their greatest heights at their top edges 74 toward the top surface 66 of the sand plate 60. The interior surfaces of the walls 68 also converge from the periphery 72 toward the center 70 of the sand plate 60.

The pedestal 62 is considerably smaller than the pedestal 18 and, as a result, must have a somewhat different configuration. Like the pedestal 18 the pedestal 62 has feet 76 which are spaced at uniform intervals corresponding to the spacing of the pairs of walls 68. Each of the pedestal legs 80 has an outer edge 82 with a reinforcing generally diamond-shaped gusset 84 thereon. The outer edges 82 are inclined outwardly from the seat 86 toward the gussets 84, and are parallel to each other and perpendiclar to the sand plate 60 between the gussets 84 and the pedestal feet 76. That is, the outer edges 82 are vertically oriented, rather than inclined, below the gussets 84.

Because of its small size the pedestal 62 cannot employ a lateral, stabilizing ring, such as the ring 54 of the pedestal 18, because such a ring would prevent concrete aggregate from flowing into the space between the legs 80. The gussets 84, however, provide sufficient strength to the legs 80 to prevent collapse of the pedestal 62, yet allow poured concrete aggregate to flow beneath the seat 86 between the legs 80 without the formation of cavities which would weaken the concrete. A plurality of the pedestals 62 are utilized with the sand plates 60 in the same manner that the pedestals 18 are deployed in combination with a plurality of the sand plates 26.

Undoubtedly, numerous variations and modifications of the invention will become readily apparent to those familiar with accessories for use in pouring concrete. Accordingly, the scope of the invention should not be construed as limited to the specific embodiments depicted and described, but rather is defined in the claims appended hereto.

I claim:

1. An improved sand plate for supporting concrete reinforcing rod pedestals comprising: a flat base having top and bottom surfaces, a center, and a periphery, and a plurality of pedestal foot channels having walls extending upwardly to their tops from said top surface of said base and extending radially from said center of said base toward the periphery thereof, wherein the height of said channel walls is greater above said periphery of said base than above said center of said base and the interior surfaces of said channel walls converge from said periphery toward said center and from their tops toward said top surface of said base.

2. A sand plate according to claim 1 formed as a unitary, molded plastic structure.

3. A sand plate according to claim 2 wherein said reinforcing rod pedestals each have a plurality of feet and said channel walls yield resiliently to receive the feed of a pedestal which are inserted into said foot channels in wedged engagement therewith.

4. In a device for supporting a reinforcing rod within concrete that is poured on an earthen bed and including a flat base having top and bottom surfaces and a pedestal having feet which rest on said top surface of said base and a concave cradle forming a rest for a longitudinal reinforcing rod, the improvement wherein said flat base has a center and a periphery and a plurality of pedestal foot channels formed by pairs of walls rising upwardly from said top surface wherein said walls have top edges which are of a height greater at said periphery than at said center and interior, facing surfaces in each pair of walls which converge from said periphery toward said center and from said top edges toward said top surface of said base.

5. A device according to claim 4 wherein said flat base with said foot channels thereon is formed as a unitary, molded plastic structure.

6. A device according to claim 4 wherein said channel walls yield resiliently to releasably receive said pedestal feet in removable engagement in said foot channels.

7. A device according to claim 4 wherein said flat base is of a disk-shaped configuration and said pairs of walls are arranged on said base at equally spaced intervals to extend from said center toward said periphery of said base, and said pedestal feet are spaced at uniform intervals corresponding to the spacing of said pairs of walls, and said pedestal has a plurality of separate legs which terminate in said pedestal feet, and which are all joined together by a laterally oriented, stabilizing ring.

8. A device according to claim 7 wherein said pedestal legs have vertically oriented outer edges which extend perpendicular to said ring from said feet.

9. A device according to claim 4 wherein said flat base is of a disk-shaped configuation and said pairs of walls are arranged at equally spaced intervals to extend from said center toward said periphery of said base, and said pedestal feet are spaced at uniform intervals corresponding to the spacing of said pairs of walls, and said pedestal has a plurality of separate legs which terminate in said pedestal feet and said pedestal legs are each provided with a reinforcing gusset and each have a vertically oriented outer edge that extends between said gusset and the pedestal foot thereon.

10. A device according to claim 4 wherein said flat base is of a disk-shaped configuration and said pairs of walls are arranged at equally spaced intervals to extend from said center toward said periphery of said base, and said pedestal feet are spaced at uniform intevals corresponding to the spacing of said pairs of walls, and said pedestal has a plurality of separate legs which terminate in said pedestal feet, and which diverge radially outwardly at an inclination from said cradle toward said feet, and said pedestal legs each have inner and outer edges, at least the upper portions of which are mutually parallel to each other, whereby a plurality of said pedestals are stackable one within another in nested fashion.

11. In a device for supporting reinforcing rods above an earthen bed upon which concrete is poured including a pedestal having a seat for cradling a reinforcing rod and legs with feet thereon for holding said seat at a desired elevation above said earthen bed and a flat bearing plate for distributing weight from a pedestal located thereon and having top and bottom surfaces, a center and a periphery, the improvement comprising a plurality of channels formed on said top surfaces of said bearing plate by upright walls rising in pairs from said top surface outwardly from said center toward said periphery to heights which are greater at said periphery than at said center and wherein said pairs of walls have mutually facing interior surfaces which converge from their greatest heights toward said top surface of said bearing plate and from said periphery toward said center of said bearing plate.

12. A device according to claim 11 wherein said pairs of walls are arranged at uniformly spaced intervals extending from said center toward said periphery of said bearing plate, and said pedestal feet are spaced at uniform intervals corresponding to the spacing of said pairs of walls, and said pedestal legs are all joined together above said feet by a laterally oriented stabilizing ring.

13. A device according to claim 12 wherein all of said pedestal legs diverge outwardly at a uniform inclination from said seat, and each of said pedestal legs has inner and outer edges at least portions of which are mutually parallel to each other between said pedestal seat and said stabilizing ring, whereby a plurality of said pedestals are stackable in nested, partially overlapping fashion, one atop another.

14. A device according to claim 13 wherein the portions of said outer edges of said pedestal between said feet and said stabilizing ring are perpendicular to said stabilizing ring.

15. A device according to claim 11 wherein said pairs of walls are arranged at uniformly spaced intervals extending from said center toward said periphery of said bearing plate, and said pedestal feet are spaced at uniform intervals corresponding to the spacing of said pairs of walls, and each of said pedestal legs has a reinforcing gusset thereon, and said outer edges of said pedestal legs are inclined outwardly from said seat toward said gussets, and are parallel to each other and perpendicular to said bearing plate between said gussets and said pedestal feet.

* * * * *